United States Patent [19]

Davy, Jr.

[11] 4,202,288

[45] May 13, 1980

[54] DRY WALL TAPE DISPENSER

[76] Inventor: Edward Davy, Jr., 505 N. Parkhill St., West Frankfort, Ill. 62856

[21] Appl. No.: 955,947

[22] Filed: Oct. 30, 1978

[51] Int. Cl.[2] ..... B05C 11/00; B05C 3/00

[52] U.S. Cl. ..... 118/41; 118/123; 118/419; 118/424; 118/428; 118/429

[58] Field of Search ..... 118/42, 41, 100, 122, 118/123, 413, 419, 428, DIG. 17; 15/256, 51, 264

[56] References Cited

U.S. PATENT DOCUMENTS

| | | | |
|---|---|---|---|
| 168,339 | 10/1875 | Miner | 118/DIG. 17 |
| 1,065,376 | 6/1913 | Leitgeb | 118/41 |
| 1,307,542 | 6/1919 | Elder | 118/41 |
| 1,902,688 | 3/1933 | Cesario | 15/264 |
| 2,348,166 | 5/1944 | Cavanaugh et al. | 118/122 |
| 3,669,070 | 6/1972 | Wallace | 118/123 |
| 3,747,154 | 7/1973 | O'Neil | 15/264 |
| 3,808,033 | 4/1974 | Mayhew | 118/419 |

*Primary Examiner*—J. Travis Brown

*Attorney, Agent, or Firm*—Kalish & Gilster

[57] ABSTRACT

A dry wall tape dispenser is utilizable with a bucket-type container of dry wall taping compound of the kind used for bulk shipment and storage. The dispenser includes a support structure for interengagement with portions of the container and includes an arrangement for supporting and positioning a roll of uncoated dry wall tape above the container for unrolling of tape into the compound. The structure includes an extension which protrudes into the container, the extension including a guide for guiding the unrolled tape so that the tape passes into the compound to a point proximate the bottom of the container for thorough coating. The apparatus is provided also with a scraper proximate the opening having an edge for scraping one face of the coated tape to wipe the compound from such face so that only one face of the tape remains coated as the tape is pulled from the opening. Various arrangements utilizing electric motor-driven pinch rolls are disclosed for pulling the coated tape from the opening, or such pulling may be manually effected.

23 Claims, 20 Drawing Figures

DRY WALL TAPE DISPENSER

BACKGROUND OF THE INVENTION

The invention relates to apparatus which is useful for applying dry wall tape and, more particularly, to a new and advantageous apparatus for dispensing dry wall tape coated with compound for direct application thereof to wall board seams, etc.

Various proposals have been made for the construction of apparatus useful for the application of compound-coated tape to dry wall panels. Typically, such proposals have envisioned more or less portable or hand-held devices for carrying a roll of uncoated tape, a coating head for applying plaster-like fluid to the tape, and structure for applying coated tape to wall panels as by pressure.

However, these prior art devices have not been found to be commercially acceptable and have been less than satisfactory in a number of respects because of certain disadvantages among which may be noted undue complexity, time-consuming difficulty in threading tape (e.g, in and out of various assemblies between guides, over and under rollers, through seals, various slots, etc.), and inability to coat the tape uniformly and thoroughly with compound.

Moreover, these prior art devices typically have required tape compound to be transferred to the device either from a remote location, through some sort of objectionably pumping arrangement, or by hand filling of a smaller container on the device from a bulk shipping container such as a pail. Consequently, need for refilling, adjustment, etc. requires interruption of the user's taping so that valuable time otherwise available for taping is lost. Time also is wasted by the difficulty of cleaning the complicated mechanisms after use. Additionally, the character of prior art devices has made them less than convenient for use because of bulkiness, weight, size, and the like.

SUMMARY OF THE INVENTION

An object of the invention is the provision of improved apparatus for dispensing dry wall tape coated with compound to facilitate direct application of coated tape to the seams, joints, corners, etc. of wall board panels utilized in so-called dry wall construction.

A further object of the invention is the provision of such apparatus which is of an extremely simple, low-cost, easily constructed, light-weight and sturdy, durable character, yet which provides thorough, uniform coating of tape so that the coated tape is in condition for being easily and very effectively applied with superior results.

Among still other objects of the invention may be noted the provision of such apparatus which is quick and convenient to use, takes little time and does not require difficulty to prepare for use, simplifies and facilitates the addition of coating compound, and is easily cleaned after use; and which is facile and mobile in use.

Yet another object of the invention is the provision of such apparatus which will continuously and automatically dispense uniformly and thoroughly coated dry wall tape at a desired rate for continuous facile application of the tape to a wall without effort or attention by a skilled worker, so that the worker may directly apply the coated tape to seams, joints, corners, etc. of joined dry wall panels with both hands and without having his attention diverted from his task.

A further object of the invention is the provision of such apparatus which makes possible the use of large, standardized shipping buckets, or pails, of tape coating compound as an integral part of the apparatus whereby tape may be coated directly from such a pail without requiring transfer of the compound from such bucket.

Other objects will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED DRAWINGS

Figure 1:
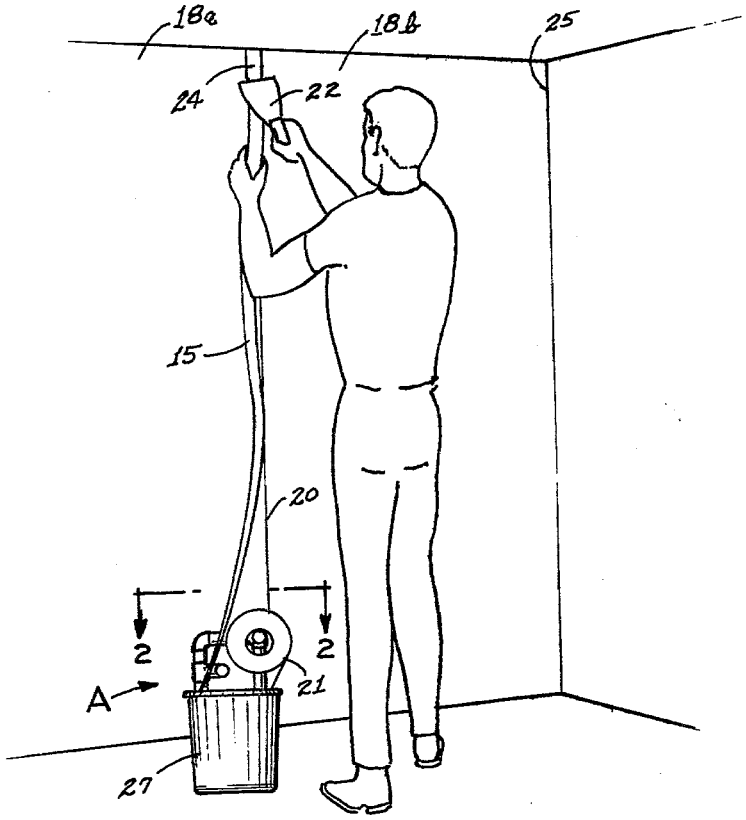
FIG. 1 is a pictorial representation of use of one form of apparatus constructed in accordance with and embodying the invention.

Referring now to FIG. 1, designated generally at A is dry wall tape dispensing apparatus as configured according to a first preferred embodiment of the invention. Apparatus A is suited for dispensing such tape in the form of a continuous strip 15 coated thoroughly and uniformly with a desired compound which typically is of thick, viscous liquid form and constituted by resin, cement, adhesive, plaster, so-called "mud," or other substances utilized for the purpose of securing tape from a roll 17 to joined panels to provide so-called dry wall construction.

Typical panels 18*a*, 18*b* are shown and may be of gypsum board, for example, which are butted together providing a seam 20 which must be taped to provide a smooth finish. For this purpose the tape is typically provided in the form of rolls such as indicated at 21.

A skilled workman is depicted as applying the coated strip 15 of tape to joint 20 by appropriate use of a blade-form tool 22 whereby tape covers the joint as shown at 24. A further coat of compound or cement, etc. may then be applied over the tape for finishing purposes if necessary. Tape from roll 21 may also be applied to other wall board joints, as at an inner corner 25 or an outer corner. Compound for the coating of tape from roll 21 is contained within a bucket or pail 27. Compound for this purpose is typically available in plastic storage and shipping pails, e.g., of five-gallon size, for this purpose. This invention permits direct use of these bulk pails.

Figure 2:
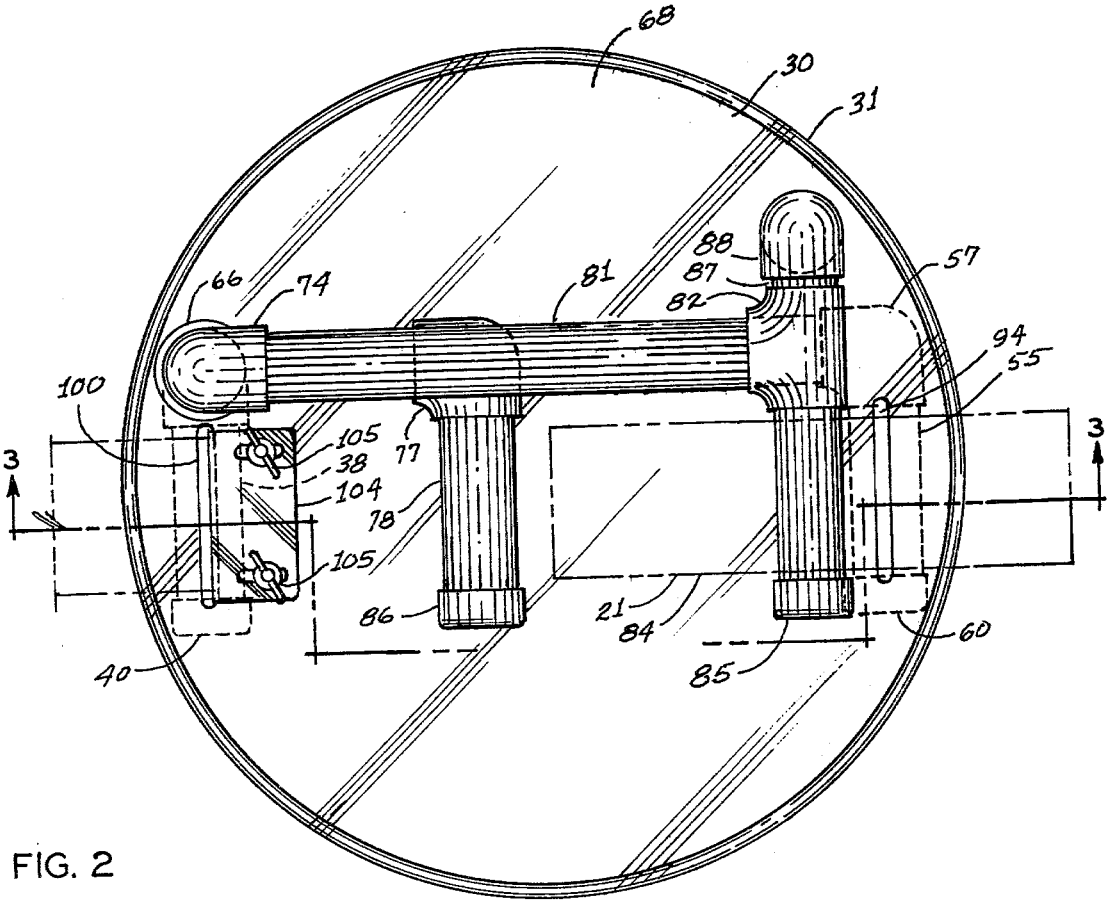
FIG. 2 is a top elevation of the apparatus of FIG. 1.
Figure 3:
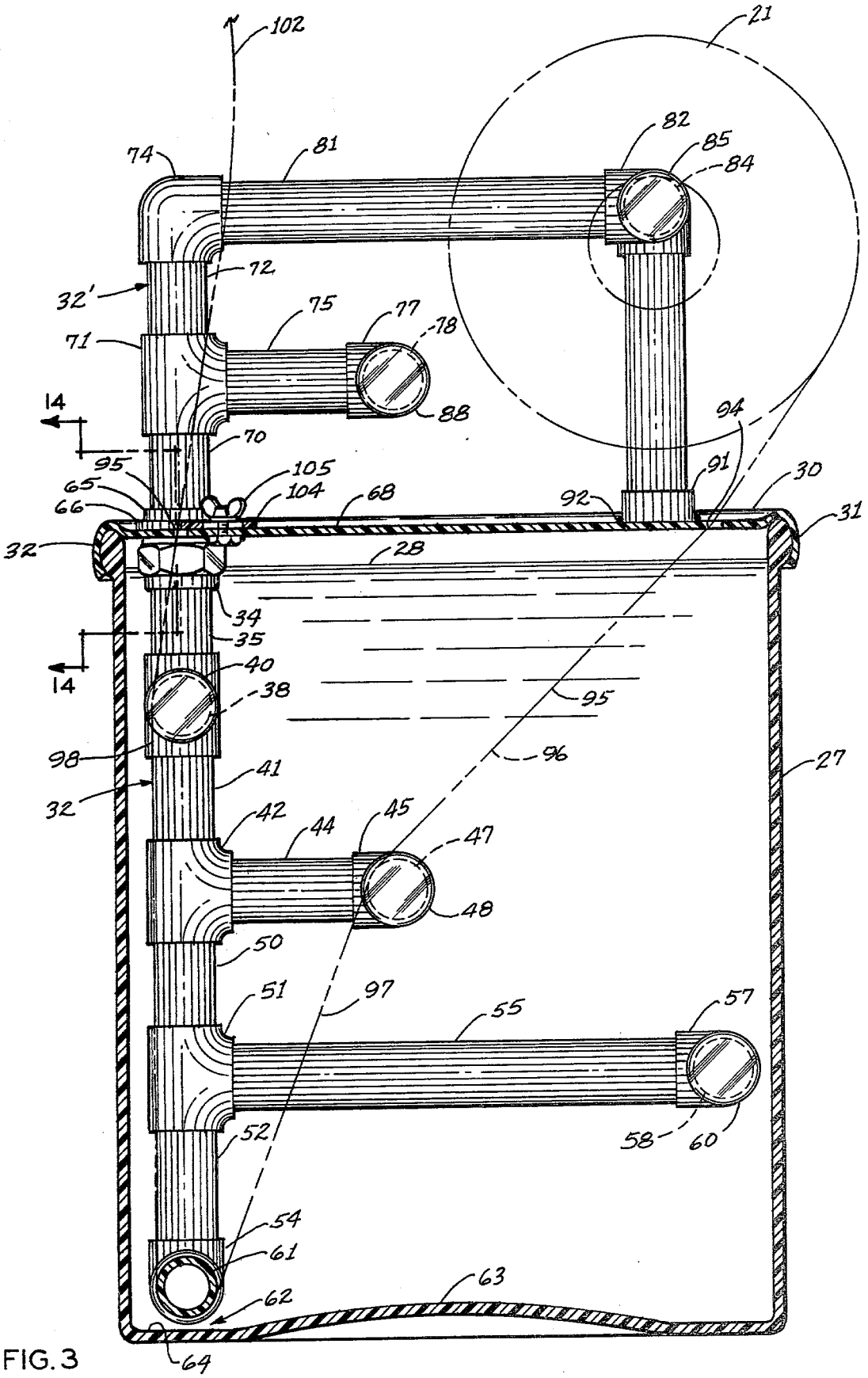
FIG. 3 is a side elevation of the apparatus of FIG. 1, with a certain container and cover shown broken away for illustration of other elements of the apparatus.

Referring now to FIGS. 2 and 3, apparatus A is deemed to include pail 27 as a container for compound which, when the pail is full, may be at a level 28. Container 27 is provided with a lid 30 for covering its top, the cover having a flanged edge 31 for resiliently engaging a lip 32 normally present on pails if the present character so as to retain the cover in place yet permit the same to be snapped off or on by hand.

Extending downward from lid 30 on the underside thereof and hence into container 27 is a lower structure of tubular form and designated generally 32. An upper tubular structure generally designated 32' is joined to lower structure 32 through the cover for providing a strong unitary assembly with the cover 30, upper structure 32', and lower structure 32 being secured to one another for strengthening the apparatus.

Each of the structures 32, 32' is formed of lengths of circular tubing and fittings, such as tees and elbows, all of synthetic resin material adapted for interfitting relationship. Preferably, such various elements all may be of polyvinyl chloride (PVC) elements of commercially available type used for plumbing and piping purposes and adapted for being simply cemented together to provide a strong, tough, resilient and fairly rigid construction which is substantially impervious to the taping compounds formed in normal use. A standard diameter of $\frac{7}{8}$" may preferably be used.

More specifically, the lower tubular structure 32 comprises a coupling sleeved 34 and length 35 of tubing extending vertically downwardly from coupling member 34. A tee coupling 37 is secured to the latter, there being a length 38 of tubing fitted to the tee and extending laterally out and perpendicular to the axis of tubing length 35 to provide a guide for the tape. Tubing 38 is closed by a pipe cape 40 of symmetrical standard configuration at its tee-remote end. Similarly, another length of tubing 41 extends vertically downwardly from tee 37 and terminates at a second tee 42 having a horizontal length of tubing 44 extending perpendicularly outward therefrom across less than half the inside diameter of the container. The longitudinal axis of tubing 44 is also perpendicular to that of tubing 38.

Tubing 44 terminates in an elbow (or so-called ell) 45. A length of tubing 47 extends laterally from and at a right angle to tubing 44 and is coplanar with tubing 44. As will be apparent, said tubing 47 has its longitudinal axis perpendicular to (but not intersecting) that of tubing members 35 and 41 and parallel to that of tubing 38 so as to provide another guide for the tape. Tubing 47 is similarly closed with a pipe cap 48 as its elbow-remote end.

Extending vertically downward from tee 42 is a further length of pipe 50. The latter terminates in a tee 51 which, in turn, has a further length of tubing 52 extending vertically downward from it and terminating in an elbow 54. Hence, it is to be seen that tubing lengths 35, 41, 50, and 52 are coaxial with respect to their longitudinal axes.

From tee 51 extends perpendicularly outward a horizontal length of tubing 55 the major part of the diameter of container 27, parallel to tubing length 44, and terminating in an elbow 57 having a length of tubing 58 extending at a right angle outwardly from it, and closed with a cap 60. Tubing 58 is not a tape guide (although it could be used for such purpose) but rather is a stabilizer for the assembly, serving effectively to facilitate insertion of the assembly into the container and to permit the composite tubular assembly to be placed stably upon a floor or other surface when not in the container. Hence, tubing lengths 55 and 60, which are coplanar and perpendicular, are seen to be quite close to the bottom of the tank and to provide an overall length, such as measured between the container wall-adjacent portions of tee 51 and the wall-adjacent portions of elbows 57 or cap 60 which is only slightly less than the inside diameter of the approximately cylindrical container 27.

Extending from elbow 54 perpendicular to tubing length 52 is yet another length of tubing 61 for serving as another guide for the tape. The latter is terminated in a cap in a manner precisely identical to the provision of caps 40, 48, and 60 for tubing lengths 38, 47, and 50, respectively. Only a very slight spacing 62 is provided between the bottom 64 of the container and the adjacent portions of tee 54 and tubing length 61 whereby tape guided around and passing over the latter will contact the compound even though the container may be nearly empty particularly since the tape is guided in close proximity with the floor or bottom 64 of the container and also in close proximity to one side wall. The crown 63 of the floor is thus avoided.

From the foregoing, it is apparent that tubing lengths 35, 41, 44, 50, 55 and 52 each lie in the same plane and that tubing lengths 38, 47, 58, and 61 are each perpendicular to this plane.

Figure 14:
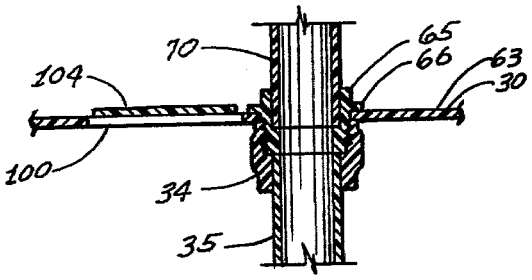
FIG. 14 is a cross-section taken along line 14—14 of FIG. 2 illustrating fittings common to some embodiments.

The upper assembly 32' is joined to lower assembly 32 by a fitting 65 which includes a flange 66 which bears against the top 68 of cover 30 and is threaded into sleeve 34 (see FIG. 14) whereby the cover is effectively clamped between elements 35 and 65.

A vertical length of tubing 70 extends upward from fitting 65 and terminates in a tee 71. A further length of tubing 72 extends vertically upward from the latter, terminating in an elbow 74. Tubing lengths 70, 72 are coaxial with tubing lengths 35, 41, etc., of the lower assembly.

Fitted to tee 71 is a horizontal length of tubing 75 which extends, of course, at a right angle to vertical lengths 70, 72. It terminates in an elbow 77 having a length of tubing 78 extending therefrom for providing a horizontal handle close to the vertical center of gravity of the apparatus to facilitate carrying. Tubing length 78 terminates in a cap 80. While perhaps not readily perceived as being of importance, this and other caps of the tubing assemblies are importantly useful for sealing the tubular structure against entrance of compound or other moisture, thus preserving the light-weight, strong character of the apparatus.

Extending perpendicularly to tubing lengths 70, 72 is a relatively long length of tubing 81, the same being parallel with tubing length 75. Tubing length 81 terminates in a tee 82. From one side of the tee extends a horizontal length of tubing 84 of length adequate for supporting thereon a roll of tape as shown in phantom at 21, the tape being retained thereon by a cap 85.

From the opposite side of tee 82 extends a very short horizontal length of tubing 87. An elbow 88 is secured to the opposite end, there being a vertical length of tubing 90 extending between the elbow and the top surface 68 of the container, being joined to the latter by a cap 91 suitably cemented, as indicated at 92 to the top surface 68. As is apparent, tubing lengths 81, 84, and 87 all lie in a plane parallel to the top surface 68 and perpendicular to the longitudinal axes of vertical tube lengths 70, 72.

Cover 30 is provided with a slot-like aperture 94 in top surface 68 of width slightly greater than the top and extending at least slightly beyond the side edges of the roll 21 of tape when the tape is supported by tubing length 84, as depicted in FIG. 2 said slot is located beneath the roll. Accordingly, tape may unroll from roll 21 and extends in a continuous length, as viewed in FIG. 3 and is guided as a first reach 95 over tubing lengths 47, then under tubing length 61, and as a further reach 98 up against tubing length 38. For this purpose, tubing lengths 47, 61, and 38 are each slightly greater than the width of the tape.

Provided in cover 30 just above tubing length 38 is another slot 100 which is in registry with such lengths of tubing for allowing the strand or length of tape to exit from the container as indicated at 102. The emerging tape 102 is coated with coating in the container.

Cover 30 is provided also with a selectively positionable blade member 104 secured in place by screws passing through the cover and having wingnuts 105. Said blade extends substantially the length of slot 100 for adjusting the geometry thereof so as, for example, to narrow the width of the slot by an amount just sufficient to ensure that any excess compound will be scraped off one face of the emerging tape 102 by one edge of the blade and that a uniform coating will be left on the opposite face of our tape.

Figure 7:
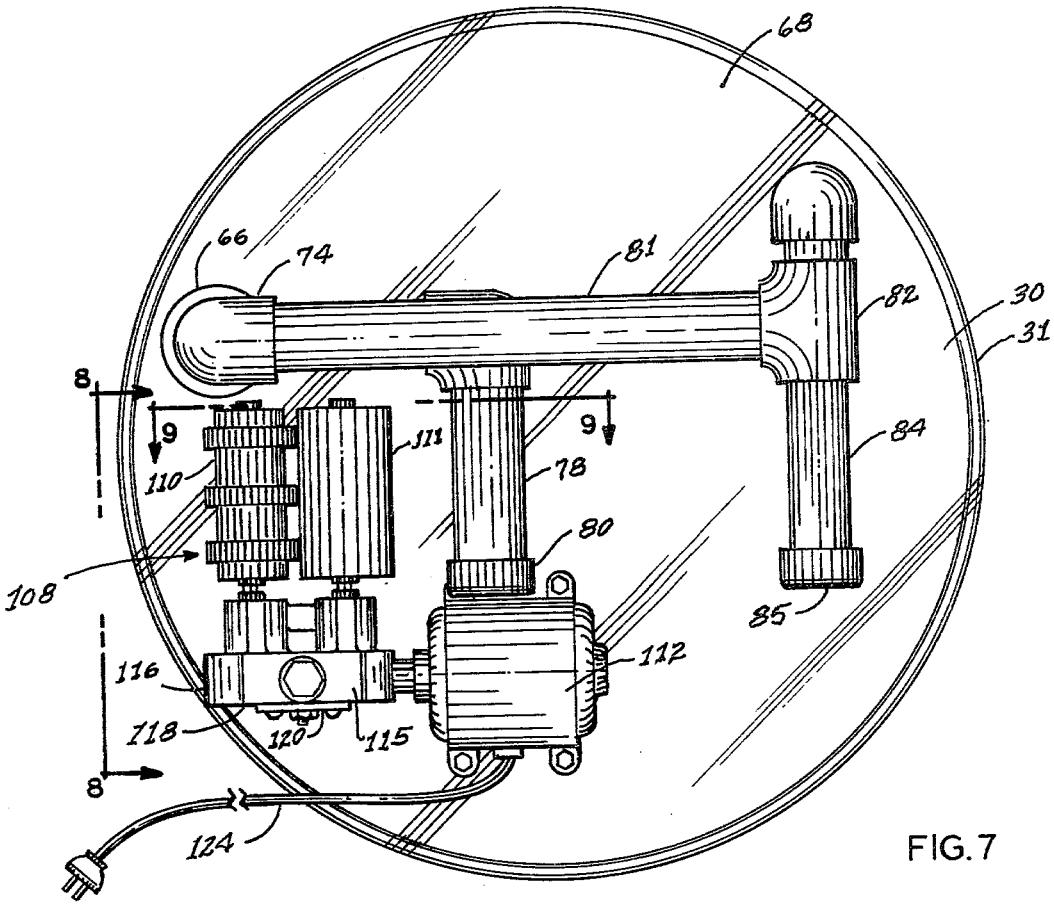
FIG. 7 is a top elevation like FIG. 2 but showing yet another form of the apparatus.
Figure 8:
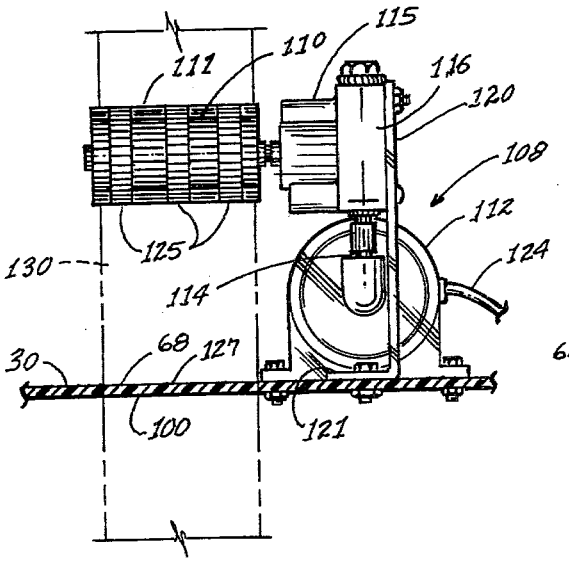
FIG. 8 is a side elevation taken along line 8—8 of FIG. 7 and particularly illustrating a tape-pulling mechanism.
Figure 9:
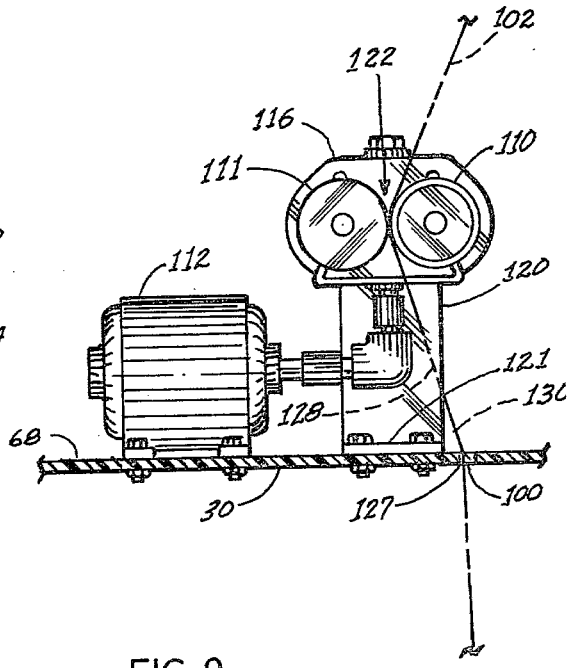
FIG. 9 is a side elevation of the tape-pulling mechanism of apparatus shown in FIG. 7, and taken as a cross-section along line 9—9 thereof.

Referring now to FIGS. 7–9, a further embodiment of the apparatus is designated 13. This embodiment is provided with a tape-pulling mechanism designated generally 108. Other elements of the apparatus remain the same and are numbered the same as for embodiment A, with the exception that the adjustable blade 104 has been omitted as it is generally believed unnecessary for this embodiment, although it well may be employed if desired, e.g., for removing excess coating.

Tape-pulling mechanism 108 comprises a pair of pinch rollers 110, 111 driven in opposite directions (FIG. 9) by an electric motor 112 through a gearing arrangement including a right-angle gear drive 114 and a double worm gear drive 115, both of commercially available type. Worm gear drive 115 includes a housing 116 having a back surface 118 which is vertically oriented, so that an upstanding leg portion of an L-shaped bracket 120 is readily secured to housing 116 by bolting to the back surface 118. A horizontal leg 121 is secured to the top surface 68 of cover as by bolting, so as to position the pinch rollers 110, 111 generally above slot 101 but with the nip 122 of the rollers being slightly offset from the longitudinal centerline of the slot (see FIG. 9) but centered laterally relative to the slot. Motor is of a suitable practical horsepower type powered by AC utility service.

Accordingly, when the motor is turned on (there being if desired, an in-line switch for this purpose in the motor power lead 124), the rollers will be driven as indicated in FIG. 9 for pulling the strand of coated tape 102 from slot 100 at a constant rate suited for direct application of the coated tape to a wall board joint.

It may here be noted that roller 111 is of a cylindrical character (e.g., of rubber) whereas roller 110 is of a grooved type having a plurality of circumferential ridges 125 spaced along its length so that it contacts the tape only with the ridges. Therefore, compound remains on the tape 102 in the areas not contacted by ridges 125. Also, significant to observe is that the tape 102, upon passing out of slott 100, is pulled across one of the longitudinal edges 127 of the slot so that compound will be scraped off, substantially keeping one face 128 of the tape 102 free of compound. The latter face is seen to be impringed in the nip 122 of the rollers against the smooth-surfaced roller 111; whereas compound remains on the opposite face 130 of the tape.

Apparatus B thus dispenses the tape which is not coated on the back surface 128 of the tape but having the opposite face 130 is coated except where engaged by ridges 125 of the roller. Therefore, the face 130 of the tape which is to be applied to a wall board joint is provided with uniform stripes of coating, in accordance with the surface of roller 110.

FIGS. 10–13 illustrate a third embodiment C of the new dape dispenser which includes a hand truck 131 having a pair of tubular rails 133, 134 each having a wheel 135 secured at one end thereof by brackets 137. A plurality of brace members 138, 138′ extend between intermediate portions of rails 133, 134, while at the upper end of the rails is provided an upper shelf 140. Between the lower extremities is carried a platform-like lower shelf 141. Handle portions extend at an angle to the rails and each has a handle thereon as indicated at 142 for facile handling of truck 131.

Container 27 is carried on lower shelf 141 and includes a cover 30 having an upper assembly 32″ generally like that designated 32′ of embodiment A and B but not equipped with the previously described support 84 for tape roll 21, although optionally may be so equipped. Instead, the tape roll is carried at 21′ between a pair of brackets 144 of suitable stock secured, by bolting, to brace 138. A spindle 145 is preferably used for supporting roll 21′, said spindle having projections received within corresponding upwardly-opening slots at the rail-remote ends of brackets 144. The arrangement supports an even larger roll of tape than embodiments A and B.

A tape-pulling mechanism 147 is carried upon upper shelf 140 which is seen to be at a height, such as about a yard above the surface 148 upon which truck 131 strands, which is very convenient for handling coated tape 102 which is provided by the mechanism.

Figure 13:
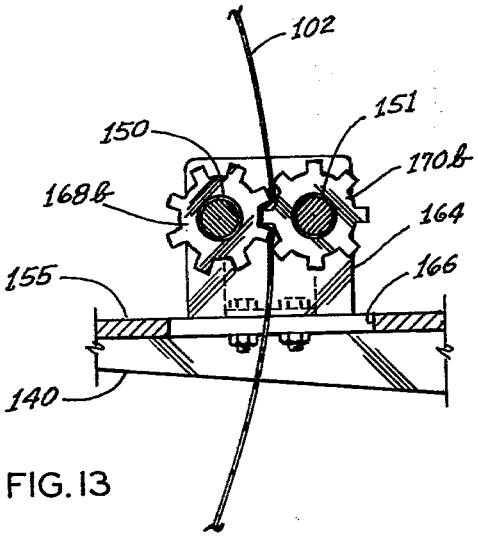
FIG. 13 is a cross-section taken along line 13—13 of FIG. 12 and depicting tape engaging features of the mechanism.
Figure 12:
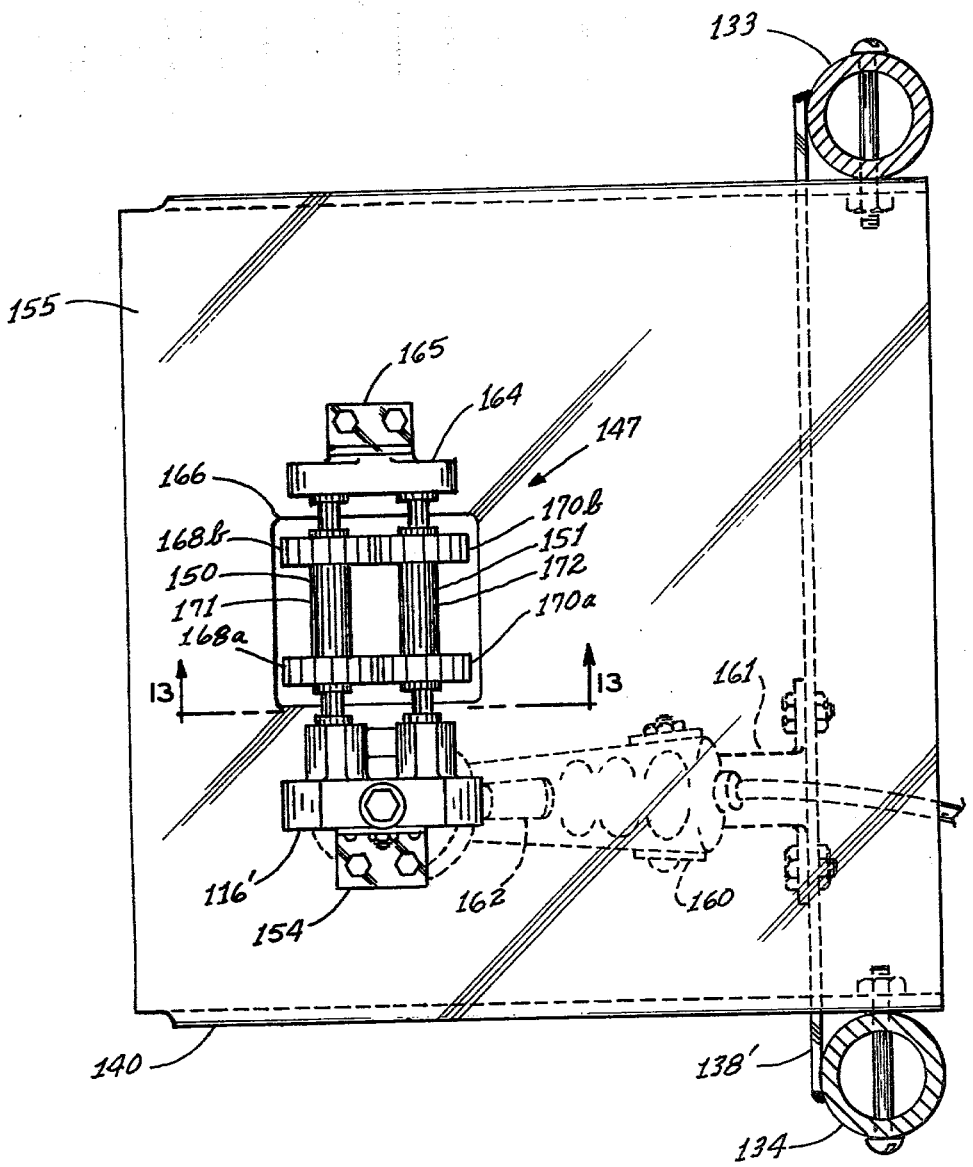
FIG. 12 is a cross-section taken along line 12—12 of FIG. 11, particularly illustrating a tape-pulling mechanism.
Figure 16:
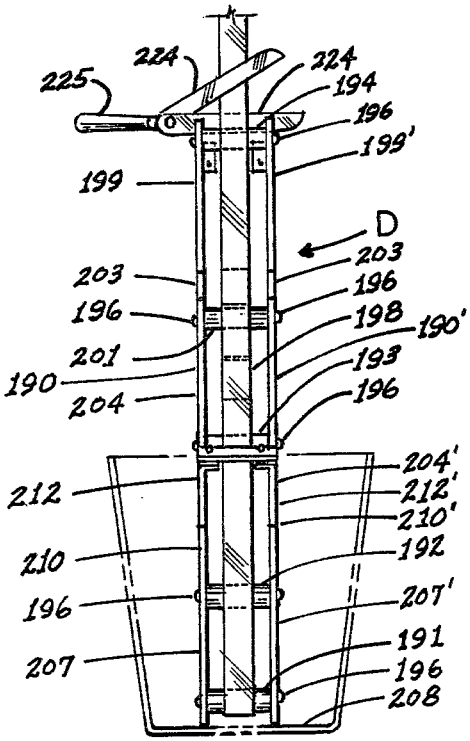
FIG. 16 is an end elevation of the dispenser of FIG. 15.

Referring to FIGS. 12 and 13, the tape-pulling mechanism 147 includes a pair of sprocketed rollers 150, 151 driven in opposite directions by a variable-speed hand-held drill unit 152 which is connected to a double worm gear drive 115' of the same type as utilized for dispenser embodiment B. The housing 116' of gear drive 115' is secured by an L-shaped bracked 154 to the upper surface 155 of shelf 140 with the drive shaft 156 of the gear drive extending through and below shelf 140 for being engaged by the chuck 156 of drill unit 152.

The handle 158 is secured to brace 138' by a U-shaped bracket 160 bolted or otherwise fastened to handle 158 and having a flanged portion 161 bolted to brace 138'. Accordingly, the trigger type switch 162 is positioned for ready access by the user. Said switch controls the speed of unit 152 and may have associated with it a lock for maintaining the switch in a fixed position to maintain a desired operating speed.

Figure 11:
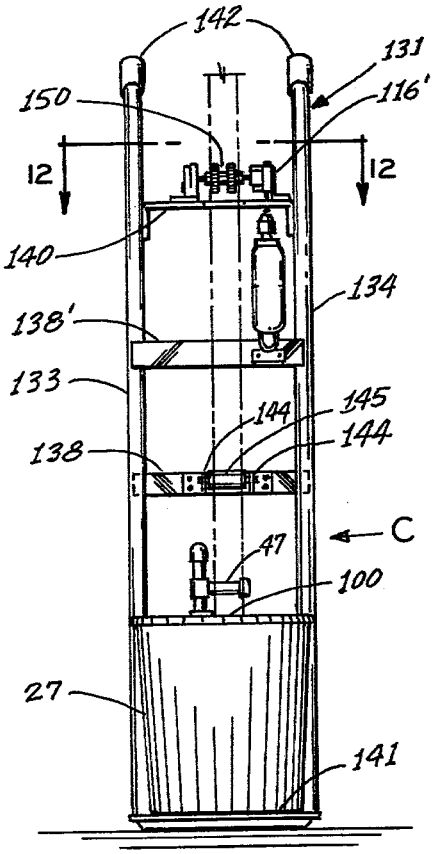
FIG. 11 is a front elevation of the embodiment of FIG. 10.
Figure 10:
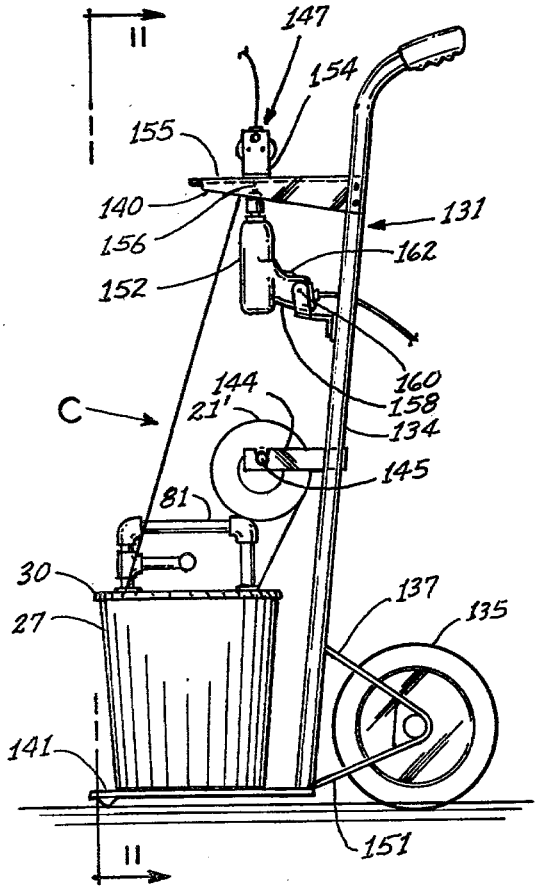
FIG. 10 is a side elevation of an embodiment of the invention configured for mobility.

The ends of rollers 150, 151 opposite from gear unit 115' are journalled in a bearing assembly 164 having a flange 165 bolted to shelf 140. Located beneath said rollers and slightly larger with the total width and length of the rollers is a generally rectangular opening 166. Vertical alignment of rollers 150, 151, opening 166, and slot 100 is depicted in FIG. 11.

The form of each of rollers 150, 151 is to be noted as different from that of tape-pulling rollers of dispenser B. Note specitically, rollers 150, 151 are of substantially identified configuration and having sprocketed flanges 168*a*, 168*b* and 170*a*, 170*b*, respectively, separated by respective narrow-diameter spindles 171, 172. Hence, the tape is engaged by the rollers only at its opposite edges. The toothed flanges may be quite thin, e.g., about ⅛ in. or ¼ in.

Figure 4:
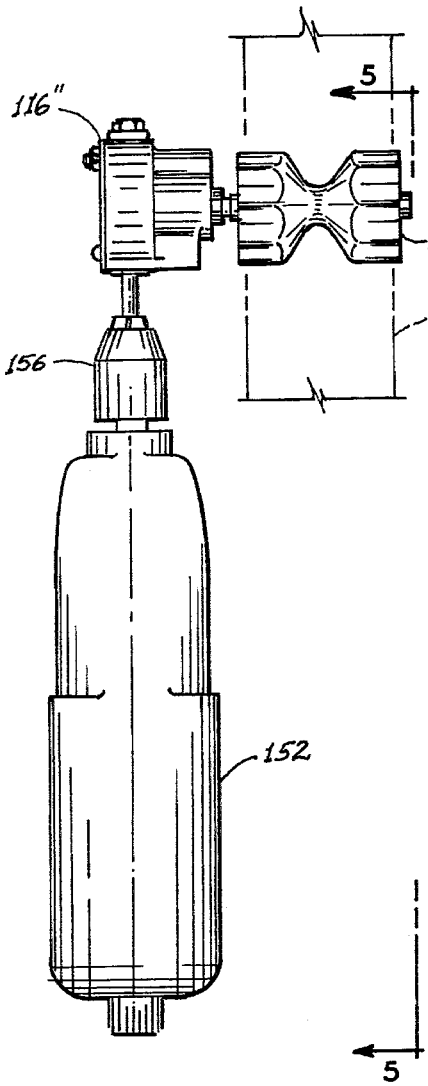
FIG. 4 is a front elevation of a tape-pulling mechanism of another form of the apparatus.
Figure 5:
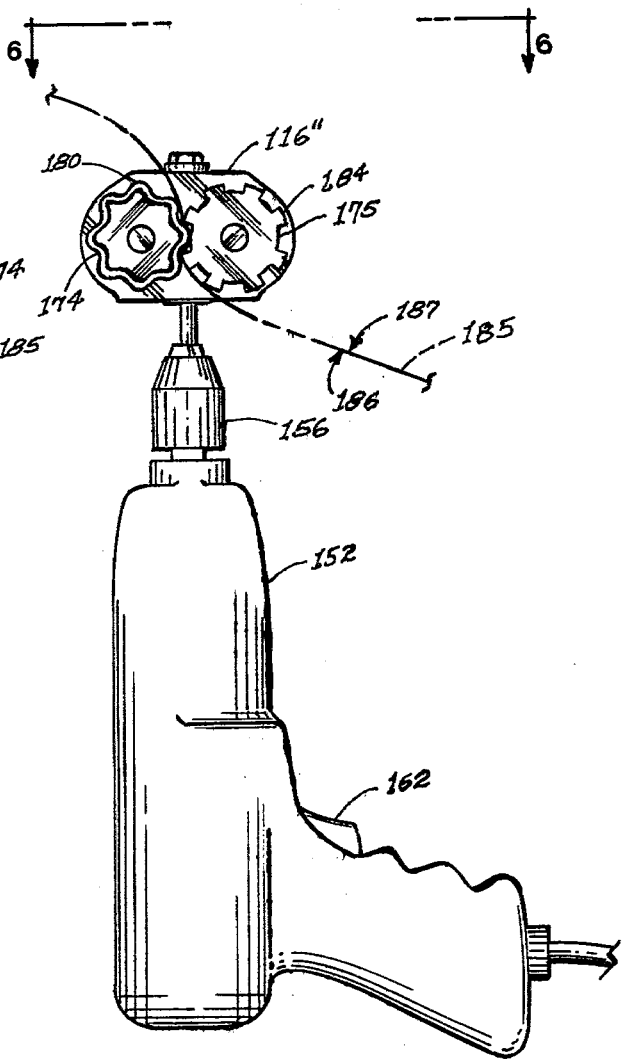
FIG. 5 is a side elevation of the tape-pulling mechanism of FIG. 1.
Figure 6:
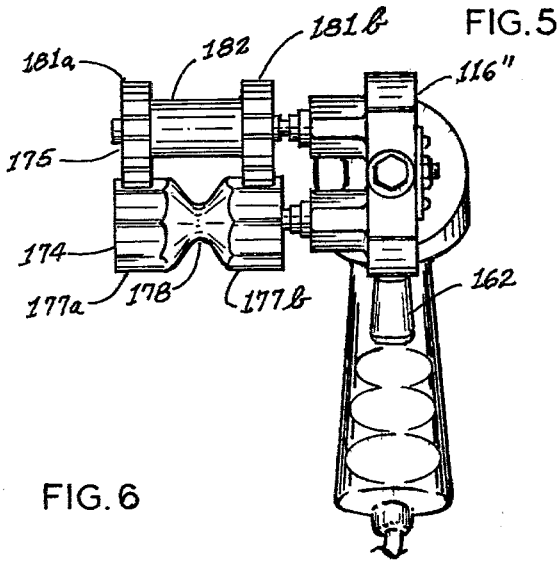
FIG. 6 is an upper end elevation of the tape-pulling mechanism.

FIGS. 4, 5, and 6 depict alternative configurations of a tape-pulling mechanism which may be utilized in connection with embodiments of the invention. Thus, these figures of the drawings illustrate a drill unit 152, of variable speed controlled by its trigger switch 162 and having its chuck 156 connected to a worm gear unit 116" of the type used with embodiments B and C. Carried by gear unit 116" are a pair of oppositely rotating rollers 174,175 of sprocketed configuration.

More specifically, roller 174 as having flanges 177*a*,177*b* at opposite ends thereof joined by a gently radiused spindle 178. Said flanges are fluted as shown in FIG. 5 but with the flutes 180 being relatively shallow and smoothly to provide a closed serpentine surface of revolution, yet retaining the character of a sprocket. Located for engagement with the fluted roller 174 is sprocketed 175. The latter has opposite end flanges 181*a*,181*b* joined by a substantially constant diameter spindle or hub, 182. Each of flanges 181*a*,181*b* carries relatively sharp edged cog-like teeth 184 which have the same pitch as the flutes of roller 174 for relative interengagement.

This roller arrangement is found to be highly effective for pulling coated tape 185 with the smoothly fluted roller 174 being well-suited for bearing against a face 186 of the tape which is substantially coated (i.e., from which most of the coating is scraped off upon pulling from container 27) and the sharp-toothed other roller 175 being well suited for bearing against the coated tape face 187 which is to be applied to wall board.

Figure 15:
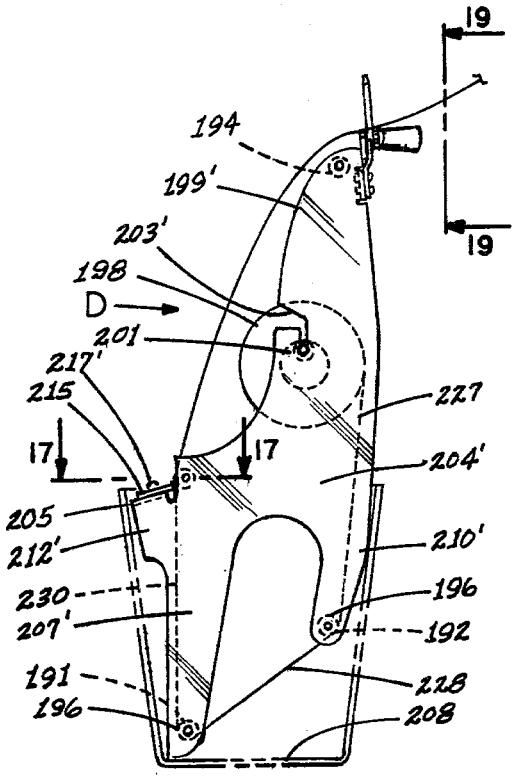
FIG. 15 is a side elevation of a further embodiment of the new dry wall tape dispenser, as inserted in a bucket of dry wall compound.
Figure 17:
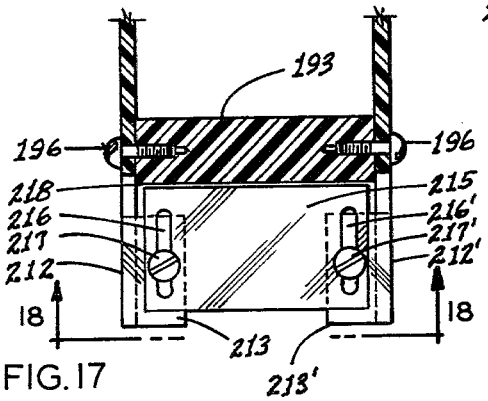
FIG. 17 is a fragmentary cross-section taken along line 17—17 of FIG. 15.
Figure 19:
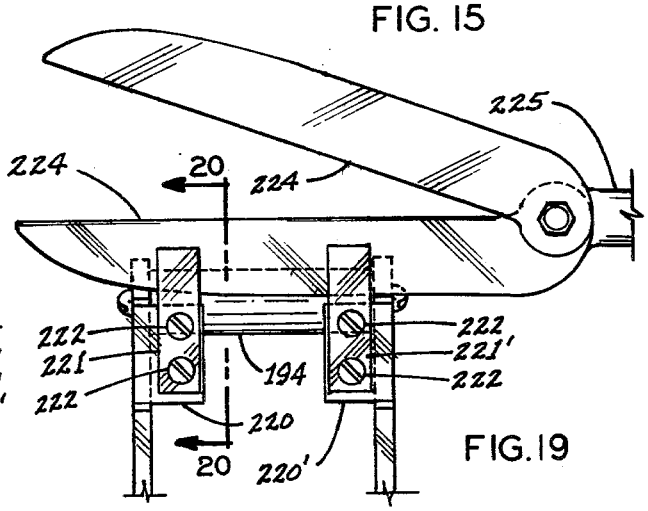
FIG. 19 is a rear elevation of a coated dry wall tape shearing assembly and related portions of the tape dispenser, as taken on line 19—19 of FIG. 15.

FIGS. 16–20 illustrate an alternative embodiment D of the invention. This embodiment is constituted by a spaced apart parallel pair of plates 190,190' which are of substantially identical shape, as depicted in FIG. 15, the plates being of suitable resilient synthetic resin material such as one of the various opaque or translucent thermoplastics now widely available, including "Plexiglass," and relatively low in cost.

The plates are spaced apart by four cylindrical spacers 191–194, preferably of similar material or wood or aluminum, to which the plates are secured by screws 196 or the like extending through respective apertures through the plates into the spacers 191–194. The spacing between plates 190,190' is sufficient to receive a roll 198 of dry wall tape without binding of the same between the plates, with the roll being supported within generally vertically extending upper portions 199,199' of the plates by a cylindrical member 201 of the same general configuration and material as that of spacers 191–194, said support 201 having similar screws 196 therein for being received in a pair of slots 203,203' in said portions 199,199', respectively.

Each of the plates 190,190' is of an esthetically pleasing curvilinear configuration with the upright upper portions 199,199' being of relatively narrow width and preferably not substantially greater than the diameter of tape roll 198 which is supported between them. Each of said plates has a respective widened central portion 204,204' substantially spanning the diameter of the opening of a conventional bucket or pail 205 of dry wall compound of the same type as that designated at 27 in FIG. 1, such opening being designated 206. Each of plates 190,190' further comprises a downwardly extending generally vertical leg portion 207,207' which extends the depth of the bucket 205 and engages the bottom 208 of the bucket. Respective shorter legs 210,210' extend downwardly from the opposite side of central portions 204,204' adjacent the opposite walls of bucket 205 for supporting the device in conjunction with legs 207,207', which are adjacent the other wall.

Figure 18:
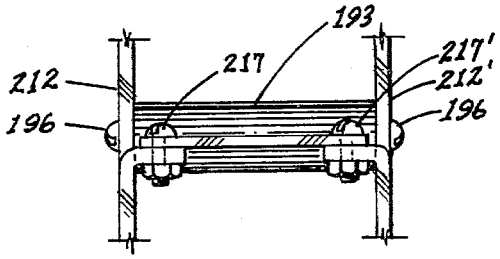
FIG. 18 is a front elevation of portions of the dry wall dispenser depicted in FIG. 17.
Figure 20:
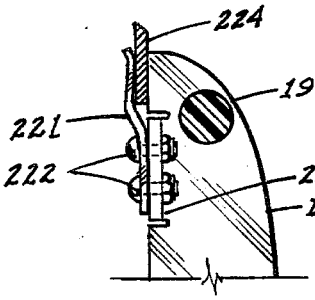
FIG. 20 is a cross-section taken along line 20—20 of FIG. 19.

A short lateral extension 212,212' of each of the central portions of each of the plates abuts the wall of bucket 205 opposite from the respective shorter legs 210,210', each such extension having a respective inwardly directed tab 213,213' extending toward the opposite plate for supporting between the plates 190,190' a scraper bar or plate 215 of general rectangular configuration having a pair of slots 216,216' receiving screws 217,217' which are threaded into tabs 213,213', which are secured thereto by nuts as shown in FIG. 18, thereby permitting the selective positioning of plate 212 backward and forward with respect to spacer 193 to define therebetween a slot 218 constituting a tape outlet aperture through which coated dry wall tape may pass.

At the upper end, i.e., at the upper extremities, of plate portions 190,190', a similar pair 220,220' of tabs is provided with such tabs each extending toward the opposite plate and each having a respective spring clip 221,221' secured thereto as by screws 222. Said clips 221 are of sufficient size for receiving and clampingly engaging one of the blades 224 of a shears 225, e.g., of the grass cutting type, but preferably having a coating of fluorinated hydrocarbom polymer material of the type conventionally employed for imparting a non-stick character to metal surfaces. Said blades 224 are oriented for shearing action in a substantially vertical plane. The shears 225 are at a height for convenient operation by the user, i.e., slightly above knee level and below the waist.

Dry wall tape from roll 198 is adapted to extend downwardly as a first reach 227 to spacer 192, and as a further reach 228 which descends substantially to or proximate the bottom 208 of the bucket, and thence around spacer 191, there being a further reach 230 extending upward through slot 219, over spacer 193, and thence upward over spacer 194 and between shear blades 224. Accordingly, tape from roll 198 is pulled downwardly into bucket 205 for being thoroughly coated with dry wall compound, but then passes upward through slot 218 for scraping excess compound off the coated tape and rendering such coating uniform. The uniformly coated tape is then conveniently cut by shears 225 for application to a wall.

As will be manifestly apparent, the pulling arrangements of FIGS. 4–6 may readily be employed with any of the embodiments previously described. Thus, for embodiment A, drill unit 152 may be readily secured, as by means of shapes or the like; to cover 30, and gear unit 116" also mounted upon or stabilized in relation to the cover by a suitable bracket, etc.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. For use with a bucket-like container adapted for holding a body of tape coating fluid and having a bottom wall and side walls extending upward therefrom to a top opening, said side walls and bottom wall forming an inside bottom corner, apparatus for dispensing coated tape comprising support means for interengagement with portions of said container including an upper extension extending upwardly from said container including tape support means for supporting a roll of uncoated tape and for positioning said roll relative to said opening to facilitate unrolling of said tape from said roll into said opening, and a lower extension extending downwardly into said container adjacent one side wall, a guide carried by said lower extension proximate the said inside bottom corner of said container, means extending from said lower extension laterally toward and proximate said opposite side wall and spanning substantially the width of said container for stabilizing said apparatus within said container, said laterally extending means being immersible in said body of fluid, said guide being adapted for guiding tape to provide a length of said tape extending from said opening into said body of coating fluid to a point proximate the bottom of said container with said tape then extending from said guide to said opening to reach said opening in thoroughly coated condition, and scraper means proximate said opening including an edge for scraping of one face of the coated tape to wipe coating fluid from said face whereby the other face of said tape remains coated as said tape is pulled from said opening.

2. Apparatus according to claim 1 wherein said container has a circular top opening having a rim and further characterized by said cover means having a surface of circular shape extending across said top opening and a circumferential flange for circumferentially engaging said rim substantially around its entire circumference, said tape inlet and outlet apertures being constituted by slots spaced apart on said surface, said structure being tubular in form and comprising a plurality of interconnected tubular elements constituting said extension and guide.

3. Apparatus according to claim 2 wherein said side walls are upright and further characterized by said tubular extension comprising tubular elements extending vertically downward from said cover along the interior side surface of said one wall, said guide being proximate said interior surface.

4. Apparatus according to claim 3 and further characterized by said laterally extending means comprising a further tubular extension extending horizontally from the first said extension to a remote end at a point proximate the interior surface of said opposite side wall, said further extension carrying at said remote end a further horizontal extension which extends laterally to and is coplanar with said further extension, said laterally extending means adapted for contacting a floor or other surface for permitting said apparatus to be stably placed thereon when not in said container.

5. Apparatus according to claim 4 and further characterized by said lower extension carrying yet another tubular extension extending horizontally from the first-said extension to a remote end point between opposite side walls, said another extension carrying at the last-said remote end a further horizontal extension which extends laterally to and is coplanar with said another extension and which services as a guide for tape entering said body of fluid, the first-said guide being constituted by a tubular member extending laterally from the first-said extension, all of said tubular members being constituted by PVC plumbing elements.

6. Apparatus according to claim 3 and further characterized by said structure comprising a further tubular structure connected to the first-said structure and extending upward from and secured to said cover surface, said further structure comprising a plurality of interconnected tubular elements, at least one of said elements being joined with a tubular element of the first-said structure by mutual securement to said cover, and interconnected tubular elements of said further structure defining a handle for said apparatus.

7. Apparatus according to claim 6 and further characterized by said tubular elements of said further structure comprising at least one vertical tubular member engaging an upper surface of said cover, and a horizontal tubular member connected thereto for constituting said tape support means.

8. Apparatus according to claim 2 and further characterized by said scraper means comprising a blade and means adjustably securing said blade to said cover on said surface in selectively positionable relationship with regard to said tape exit aperture whereby the geometry of said aperture may be varied by repositioning of said blade.

9. Apparatus according to claim 2 and further comprising tape pulling means comprising a pair of opposed counter-rotatable pinch rollers positioned for receiving coated tape from said tape exit slot, an electric motor for providing power for said rollers, and gear means connecting said motor to at least one of said rollers for rotating said rollers to pull tape from said exit slot.

10. Apparatus according to claim 9 and further characterized by at least one said rollers having annular flanges for contacting said tape on only parts of a respective tape face.

11. Apparatus according to claim 10 and further characterized by said flanges being fluted.

12. Apparatus according to claim 11 and further characterized by said electric motor comprising a variable-speed electric drill motor unit, and means securing said unit to said apparatur.

13. Apparatus as set forth in claim 9 and further characterized by a two-wheeled hand cart having a platform for said container.

14. Apparatus according to claim 1 and further characterized by said support means comprising a pair of spaced elongated members each having a central portion fitting within and bridging said top opening, said elongated members defining a pair of legs each extending downward from said central portion and constituting said lower extension, each said leg lying proximate said one side wall of the container along the length of said one side wall from said opening substantially to said bottom, each said leg contacting said container bottom wall for supporting said apparatus from said bottom wall proximate said one side wall, and said elongated members each including an upright portion extending upwardly from said central portion and constituting said upper extension, at least one of said elongated members including means for engaging said opposite side wall of said container opposite from said leg for supporting said apparatus also from said opposite side wall, said apparatus including means for maintaining the spaced relationship of said pair of elongated members.

15. Apparatus according to claim 14, said means for maintaining the spaced relationship of said pair of elongated members comprising a plurality of spacers interposed between opposite faces of said pair of elongated members.

16. Apparatus according to claim 15 wherein said pair of spaced elongated members each comprises a relatively thin sheet of resilient synthetic resin material.

17. Apparatus according to claim 15 wherein said guide carried by said lower extension is presented by at least one of said spacers.

18. Apparatus according to claim 17 and further characterized by each of said spaced elongated members each including a second leg extending downwardly from said central portion proximate said opposite side wall, said means for engaging said opposite side wall being at least a portion of said second leg.

19. Apparatus according to claim 15, said upright portions each having a slot, said tape support means comprising means extending through said roll of tape between said elongated members and interengaging said slots.

20. Apparatus according to claim 18 further comprising second guide means for guiding tape into said body of coating fluid and constituting one of said spacers, which spacer extends between the respective second legs of said elongated members.

21. Apparatus according to claim 17, said scraper means comprising a blade and means adjustably securing said blade to the respective sheets in selectively positionable relationship with respect to one of said spacers, whereby a tape outlet aperture of selectively variable geometry is provided between said blade and the last-said spacer.

22. Apparatus according to claim 14 and further comprising means carried by at least one of said upper extensions proximate the upper extremity thereof for securement of a shears with the blade of said shears extending transversely with respect to coated tape pulled from said opening.

23. Apparatus according to claim 22, the last said means for securement of a shears comprising a clamp carried at the upper extremity of each of the respective upper extensions for clampingly engaging one blade of said shears with said blade extending transversely between said clamps and with the other blade being free and located above the first said blade, for shearing of said tape by said blades in a substantially vertical plane.

* * * * *